United States Patent [19]

Doerner et al.

[11] 4,009,576

[45] Mar. 1, 1977

[54] REGENERATOR FOR ROTARY RANKINE CYCLE ENGINES

[75] Inventors: William Allen Doerner; Oral R. Van Buskirk, both of Wilmington, Del.

[73] Assignee: E. I. Du Pont de Nemours and Company, Wilmington, Del.

[22] Filed: Dec. 4, 1975

[21] Appl. No.: 637,685

Related U.S. Application Data

[63] Continuation-in-part of Ser. No. 520,344, Nov. 4, 1974, abandoned.

[52] U.S. Cl. ..... 60/669; 165/8; 60/670

[51] Int. Cl.[2] ..... F01K 11/02; F01K 11/04

[58] Field of Search ..... 60/670, 671, 669; 122/11; 165/4, 8

[56] References Cited

UNITED STATES PATENTS

| | | | |
|---|---|---|---|
| 2,978,227 | 4/1961 | Hess | 165/8 |
| 3,613,368 | 10/1971 | Doerner | 60/669 |
| 3,850,147 | 11/1974 | Doerner | 60/669 |

*Primary Examiner*—Allen M. Ostrager

[57] ABSTRACT

A regenerator for rotary Rankine cycle engines having an annular boiler and an internal coaxial expander for pressure vapor generated in the boiler, comprising at least one annular series of axially extending heat exchange tubes disposed radially inward of the boiler and an array of axially spaced annular fins on each of said tubes which rotate with the engine. A condenser for the exhaust vapor rotates with the engine and means is provided for conducting exhaust vapor to the condenser after passing through the regenerator fins and for returning liquid condensate from the condenser to the regenerator for passage through the tubes thereof in heat exchange relation with the exhaust vapor conveyed between the fins on the tubes.

10 Claims, 6 Drawing Figures

REGENERATOR FOR ROTARY RANKINE CYCLE ENGINES

This application is a continuation-in-part of our parent application U.S. Ser. No. 520,344, filed Nov. 4, 1974, now abandonned.

This invention relates to new and useful improvements in regenerators for rotary boiler and combustor devices. The invention is particularly applicable for use with organic high molecular weight power fluids, and is especially adapted for use with rotary closed Rankine cycle engines powered by the vapors of such power fluids.

Certain saturated vapors useful in powering Rankine cycle engines superheat upon isentropic expansion. A portion of the vapor superheat thermal energy can be recovered in a regenerator and be used to preheat the power fluid condensate that is fed to the boiler. The use of a suitable regenerator both improves engine efficiency and reduces the size of the boiler and condenser that would otherwise be required.

One of the problems with such a regenerator is the difficulty in obtaining high performance with acceptable liquid-side and, especially, vapor-side pressure drops. An additional problem in rotary Rankine cycle engines is to provide a suitable regenerator that is both sufficiently light in weight and of good structural integrity.

With the foregoing in mind, an object of the present invention is to provide a regenerator of the character set forth having a high ratio of heat transfer surface to heat exchanger volume.

Another object of the invention is to provide a regenerator having high ratio of cross sectional area for flow to vapor flow path length so as to minimize vapor pressure drop.

Another object of the invention is to provide a regenerator of the type described that embodies a structural design that is compact, stable, lowly stressed, can be constructed at low cost of metal tubing and sheet material, and is capable of withstanding the forces and stresses generated by rotation of the engine.

Another object of the invention is to provide a rotary engine and regenerator construction and arrangement that provides a high vapor-side convective heat transfer coefficient as the result of the narrow spacing between the regenerator annular fins, and without appreciable reduction of the available vapor pressure head.

Another object of the invention is to provide, effectively, a regenerator as described having a low liquid-side thermal resistance through the use of tubes filled with small elements of high thermal conductivity sintered together and to the tubes to provide good thermal contact between the elements and between the elements and the tube wall.

Another object of the invention is to provide a regenerator heat exchanger of balanced design with comparable thermal resistances on both liquid and vapor side so tht neither side tends to be the limiting heat transfer resistance.

A further object of the invention is to provide a regenerator having multiple parallel paths for liquid flow so as to minimize liquid-side pressure drop.

A still further object of the invention is to provide a regenerator having minimum liquid holdup so as to minimize the effect of temperature variations on the boiler-liquid level.

These and other object of the invention and the various features and details of the construction and operation thereof are hereinafter set forth and described with reference to the accompanying drawings, in which.

Figures 1, 6:
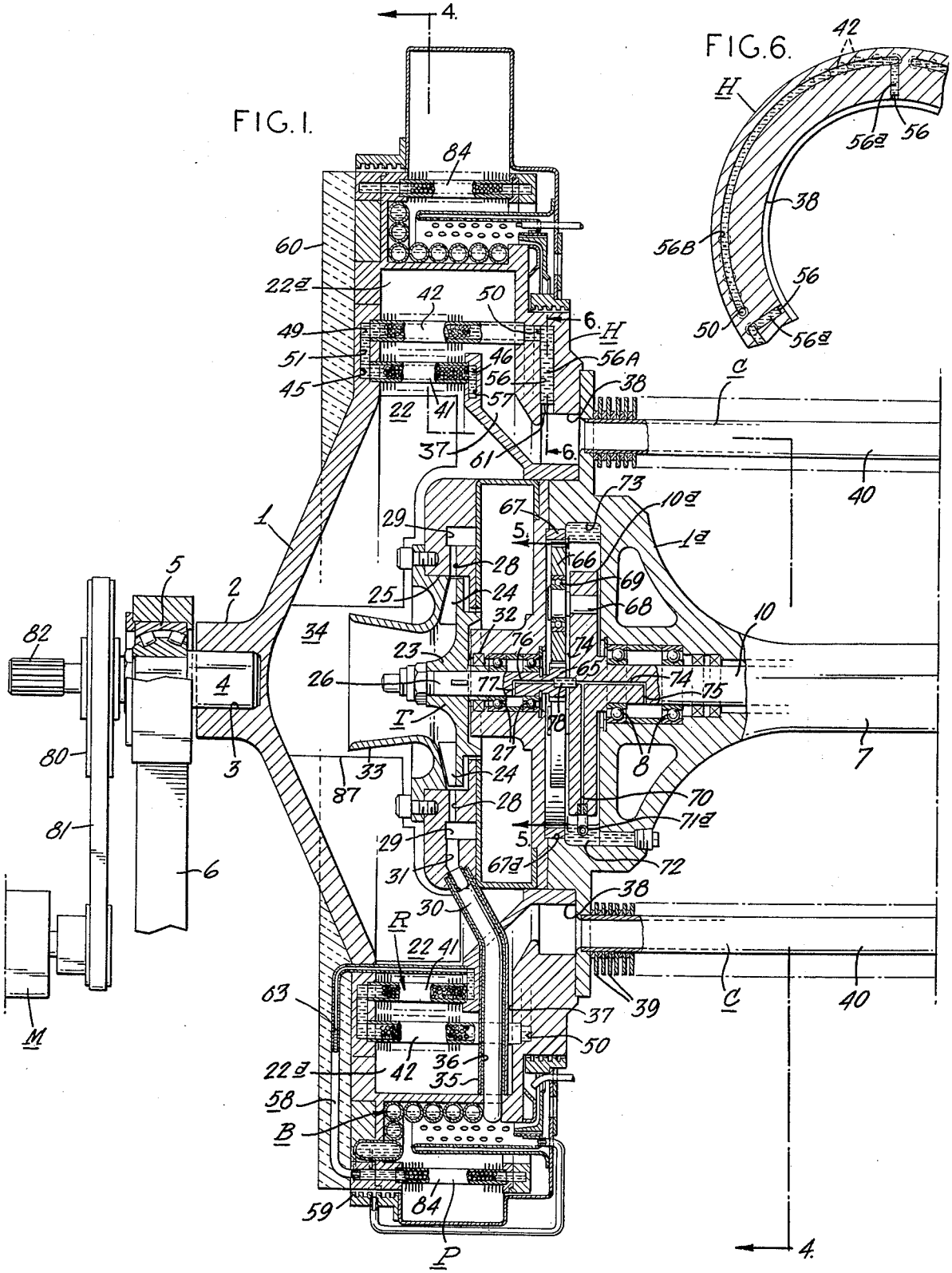
FIG. 1 is an enlarged fragmentary sectional view diametrically through one portion of a rotary engine embodying a regenerator made according to the present invention.
FIG. 6 is a fragmentary sectional view on line 6—6, FIG. 1.
Figure 2:
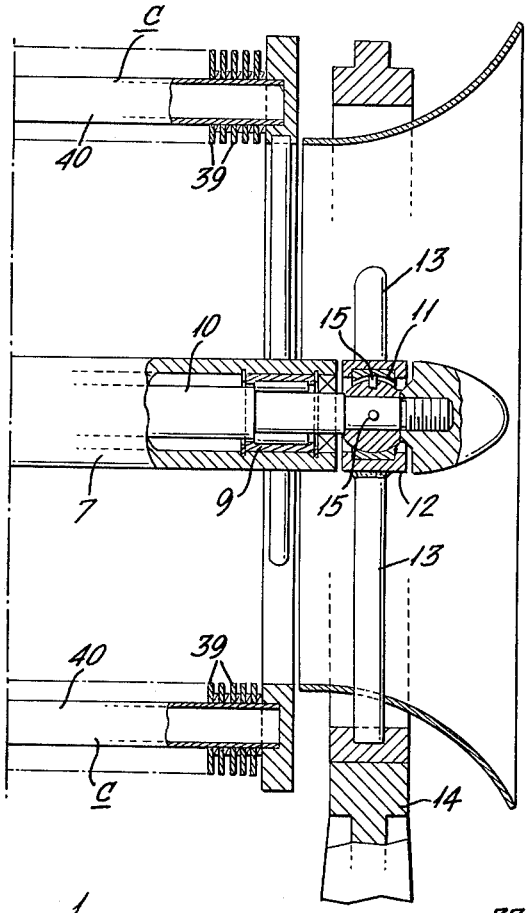
FIG. 2 is a fragmentary side elevational view, partially in section, of the other portion of the rotary engine as shown in FIG. 1.
Figure 3:
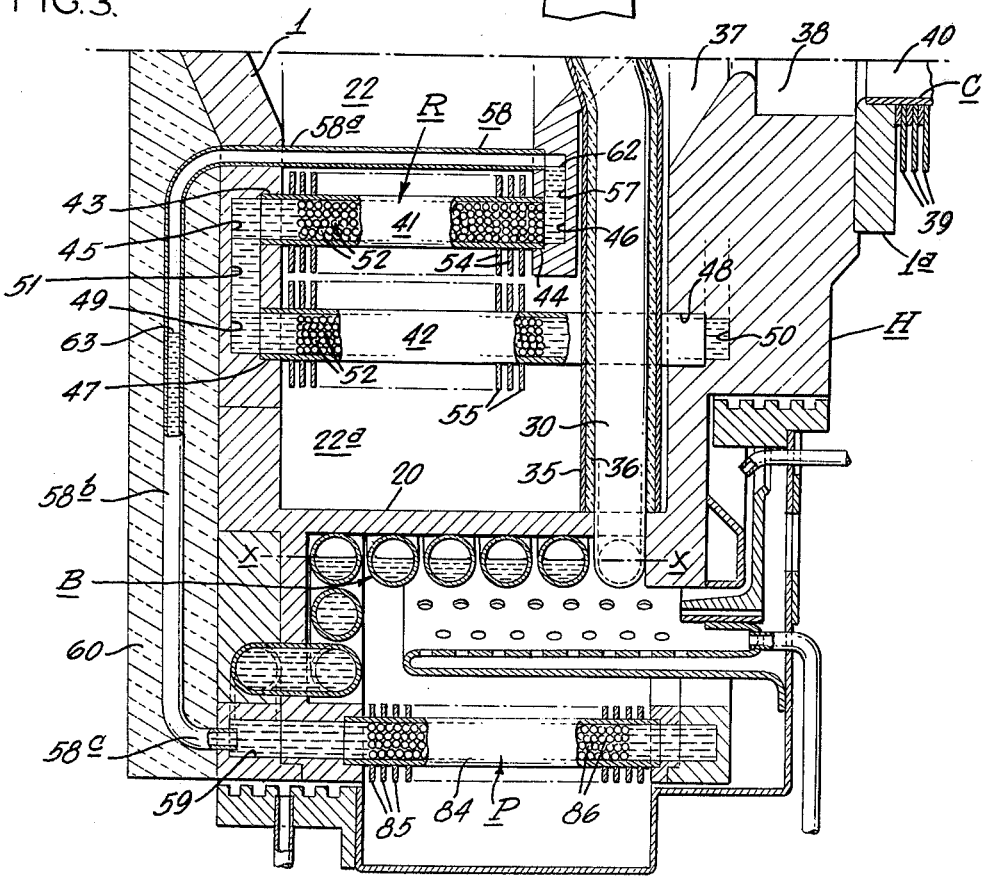
FIG. 3 is an enlarged fragmentary sectional view of a portion of FIG. 1 showing details of the construction of the regenerator.
Figure 4:
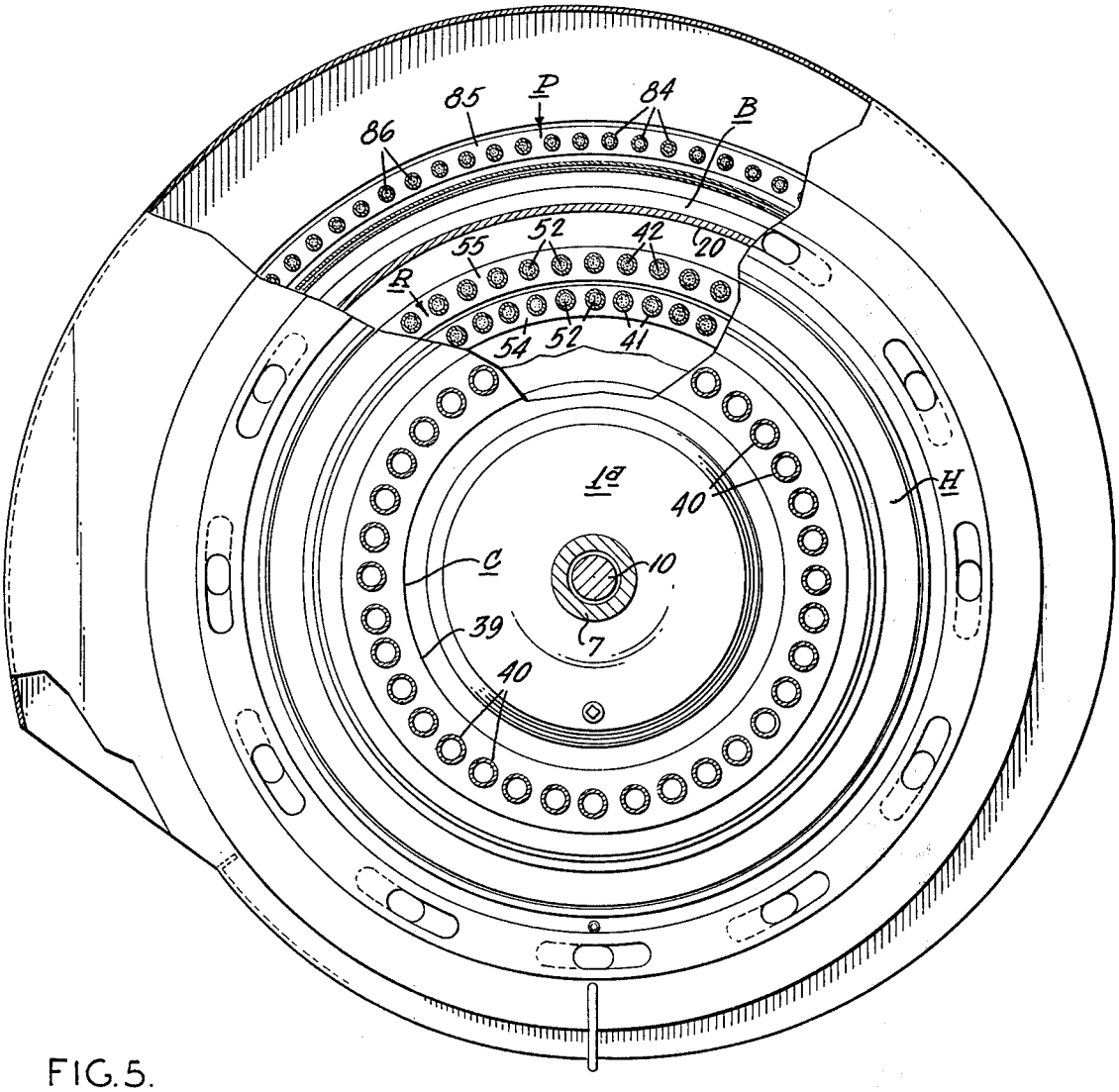
FIG. 4 is a view, partially in section, on line 4—4, FIG. 1.

Referring now to the drawings, and more particularly to FIGS. 1 and 3 thereof, one embodiment of a regenerator R made according to the present invention is shown in a closed Rankine cycle engine comprising a rotary housing H and boiler B, and a rotary condenser C coupled to the housing and boiler for rotation therewith as a unit.

The housing H includes a side wall portion 1 having a coaxial hub 2 provided with a central bore 3 extending axially therein. Mounted in the bore 3 is a shaft 4 that is secured in the hub 2 for rotation therewith. The shaft 4 projects axially outward from the housing portion 1 and is journalled in a bearing 5 that is mounted in a fixed standard or support 6. The opposite side wall portion 1*a* of the housing H includes a coaxial tubular shaft 7 that is rotatably mounted by means of bearings 8 and 9 upon a coaxially extending stationary shaft 10. The outer end of the stationary shaft 10 is mounted in a bearing 11 housed in a hub structure 12 supported coaxially of the rotary engine by means of radial spokes 13 from a fixed support 14. The shaft 10 is secured against rotation by means of radial pins 15.

In the embodiment of the invention illustrated, the construction and operation of the rotary boiler B, the surrounding combustor, and the boiler liquid preheater P (with one exception hereinafter set forth), are identical to the boiler combustor and pre-heater shown and described in U.S. Pat. No. 3,850,147, issued Nov. 26, 1974 to which reference may be had, and a description thereof need not be repeated.

The boiler B is mounted on the outer surface of a cylindrical wall portion 20 of the rotary housing H and this wall portion 20 is spaced radially outward from the housing axis to provide an annular chamber 22 within the housing H in which is mounted the regenerator R of the present invention, as more particularly described hereinafter. The rotary housing H and boiler B are adapted to be driven about their axis at a predetermined speed of rotation calculated to create the centrifugal force necessary to maintain the selected boiler liquid therein uniformly at the same depth circumferentially with a liquid/vapor interface, indicated at *x*, that is highly stable and essentially cylindrical and concentric with the axis of rotation with the boiler. The inventory of boiler liquid with which the boiler is charged is predetermined to insure that the boiler B is about half full, as shown, at full power output of the boiler and at least partially filled at minimum power. Essentially, the liquid/vapor interface *x* is disposed at a predetermined radius from the rotation axis of the boiler to provide high boiling heat fluxes in excess of those obtainable at ambient gravity.

The high pressure vapor generated in the boiler B is discharged to an internal expander, such as a turbine T, mounted coaxially within the rotary housing H. The turbine T shown, is of the single stage type comprising a rotor 23 having a series of radially extending turbine blades 24. The turbine rotor 23 is mounted within an annular recess 25 provided in the housing structure and is mounted for coaxial rotation independently of the housing H and boiler B on a coaxial shaft 26 that is rotationally mounted in bearings 27. An annular series of nozzles 28 is provided in the housing structure circumferentially adjacent the turbine rotor 23 and in confronting relation to the blades 24 thereof. An annular high pressure vapor manifold 29 is provided in the housing structure and leads to the nozzles 28.

High pressure vapor is supplied from the boiler B to the manifold 29 by a plurality of radially extending vapor tubes 30 and connecting passages 31 arranged in equally spaced relation circumferentially of the axis to insure rotational balance in the unit. The high pressure vapor is discharged from the manifold 29 through the nozzles 28 and impinges upon the blades 24 to drive the turbine rotor 23 and its shaft 26 at the desired speed of rotation. A seal 32 is provided on the shaft 26 inwardly adjacent the turbine rotor 23 to minimize migration of the pressure vapor from the turbine along said shaft 26.

A diffuser 33 is mounted coaxially in the housing to receive the exhaust vapor from the expander, such as turbine T, and exhaust vapor entering the diffuser 33 is discharged into an exhaust chamber 34 in the rotary housing H from which it passes radially to the regenerator chamber 22. Baffles 87 in the regenerator chamber 22 constrain the exhaust vapor to rotate with the engine. To thermally insulate the high pressure vapor tubes 30 from the lower temperature of the exhaust vapor in the regenerator chamber 22, the vapor tubes 30 are enclosed within concentric sleeves 35 of larger diameter than said tubes 30 and the space therebetween filled with insulating material 36.

Exhaust vapor from the turbine T entering the chamber 22 passes through the regenerator R, hereinafter described, and then flows inwardly through an annular passsage 37 to a condenser manifold 38 and thence to the condenser C, where it is condensed and the condensate returned to the boiler B through said regenerator R and pre-heater P as later set forth. In the illustrated embodiment of the invention, the condenser C comprises a coaxial array of radially disposed annular fins 39 having a plurality of heat exchange tubes 40 extending longitudinally therethrough, and is constructed and operable as shown and described in U.S. Pat. No. 3,866,668, issued Feb. 18, 1975.

As described in said U.S. Pat. No. 3,866,668 the axial spacing or distance between the adjacent fins 39 and the ratio of the inner to outer radii thereof is critical and must be determined with relation to both the rotational speed at which the unit is designed to be driven and the kinematic viscosity of the condenser cooling fluid to provide a Taylor number that is operable at the fin radii ratio to utilize the viscous properties of the cooling fluid and the shear forces exerted thereon by the rotating fins 39 to convey and accelerate the fluid spirally outward between said fins by viscosity shear forces. For optimum results, the condenser has a Taylor number in the range of about 5.0 to 10.0 preferably about 6.0, and the inner to outer radii ratio of the fins 39 is in the range of about 0.70 to 0.85, preferably about 0.77. Fin radii ratios greater than 0.85 provide lower fin areas and lower power consumption for the same heat exchanger capacity but usually are unable to accommodate tubes of sufficient diameter to provide for suitable fluid flow through the tubes without excessive pressure drop. However, in the case of preheaters with only one tube row, which have a much larger diameter than regenerator and condensers, fin radii ratios greater than 0.85 are often possible.

According to the present invention the regenerator R comprises one or more annular series of a plurality of axially extending heat exchange tubes, having annular fins thereon, arranged circumferentially in equally spaced relation within the regenerator chamber 22 of the rotary housing H and rotatable therewith. In the embodiment of the invention shown in the drawings, the regenerator R comprises two concentric radially spaced series of heat exchange tubes including an inner annular series of circumferentially equally spaced tubes 41 and an outer such series of tubes 42.

As best shown in FIG. 3, each of the inner series of regenerator tubes 41 has its opposite end portions mounted in openings 43 and 44 respectively, provided in the wall structure of the housing H and the outer ends of these openings 43 and 44 communicate respectively with annular manifolds 45 and 46. In similar manner each of the outer series of tubes 42, which in the illustrated embodiment of the invention are of greater axial length than the inner tubes 41, has its opposite ends mounted in openings 47 and 48, respectively, that communicate respectively with annular manifolds 49 and 50. A plurality of circumferentially equally spaced radial passages 51 interconnect the inner and outer regenerator tube manifolds 45 and 49.

In accordance with the present invention, corresponding portions of the tubes 41 and 42 of the regenerator R are each filled with a plurality of small elements 52 of high thermal conductivity such as, for example, spheres or balls or other geometric shapes of high thermal conductive material. Where the nature of the material of the elements 52 permits, such as, for example, in the case of metal elements 52, said elements and the heat exchange tubes preferably are sintered to bond them to one another and to the tubes to provide good heat transfer from the tubes 41 and 42 to the liquid condensate from the condenser C passing through said regenerator tubes 41 and 42. The elements 52 may be the smallest size capable of providing an acceptable operational compromise affording high heat transfer from the tubes 41 and 42 and low pressure drop in the liquid condensate flowing through said tubes. It has been found, for example, that good results may be obtained by the use of spheres or balls 52 having a diameter in the range of about 0.02 inch to about 0.04 inch. The spheres or balls 52 occupy about 60 percent of the volume of each tubes 41 and 42 thereby reducing the holdup of liquid condensate in the regenerator tubes and minimizing variation in the boiler liquid level that may otherwise occur as the result of liquid density variations due to changes in temperature in the regenerator. Further reduction in liquid holdup can be effected by using mixtures of spheres of different diameters within the aforesaid range and by filling the tubes 41 and 42 more completely than shown in FIGS. 1 and 3. The elements 52 are not limited to spherical or ball shape and may be, for example, cylindrical, rectangular cross-sectioned, or otherwise as desired. Also, the tubes 41 and 42 may be provided with internal fins as and for the purpose set forth in U.S. Pat. No. 3,773,106, issued 20, 1973.

Secured externally on each of the inner and outer series of tubes 41 and 42, is an array of a plurality of radially disposed closely spaced annular fins 54 and 55, respectively. A small radial space is provided between the fins 54 and 55 to thermally isolate the two sets of fins from each other. The tubes and fins are fabricated of metal having high thermal conductivity such as, for example, aluminum, copper, brass and the like, and the fins preferably are bonded to the tubes to provide maximum thermal conductivity therebetween.

The axial spacing of the regenerator fins 54 and 55 on the tubes 41 and 42 is made as small as possible so as to provide a high laminar-flow convective heat transfer coefficient for the vapor while still providing an acceptable pressure drop across the regenerator. The cylindrical shape of the regenerator provides a very short radial vapor flow path with a very large transverse flow area. Thus, the pressure drop of the vapor across the regenerator can be kept to an acceptable value in spite of the closely spaced regenerator fins. It is a consequence of the regenerator-design that high thermal performance is achieved in a compact heat exchanger with only small sacrifice in vapor flow pressure drop. As a result, much of the exhaust vapor superheat is removed.

The illustrated embodiment of the regenerator R is a two-pass counter crossflow heat exchanger of inverted order with the liquid condensate flowing through the tubes 42 and 41 mixed throughout and the exhaust vapor passing between the fins 54 and 55 unmixed throughout, and provides a good compromise between simplified construction and high performance. However, other arrangements and construction of the regenerator are possible such as, for example, one-pass, multiple-pass, cocross-flow, identical order, and the like, as may be desired or required in a particular engine installation.

As previously stated, exhaust vapor from the expander that flows outwardly between the regenerator fins 54 and 55 as described, flows inwardly through the annular passage 37 to the condenser manifold 38 and enters the condenser tubes 40 where it is condensed by the cooling fluid, such as air, discharged outwardly between the condenser fins 39 as previously described. The liquid condensate flows inwardly from the condenser tubes 40 and returns to the manifold 38 from which it is conveyed outwardly by centrifugal force through a plurality of circumferentially equally spaced passages 56 to the regenerator manifold 50. As shown in FIG. 6, each of the passage 56 includes a radial leg 56*a* and a circumferentially extending portion 56*b*, thereby providing an arrangement that substantially reduces back flow of condensate from the regenerator to the condenser when the engine is stopped and rotation ceases.

From the manifld 50 the liquid condensate flows through the outer series of regenerator tubes 42 to the manifold 49, thence inwardly through radial passages 51 to the manifold 45 and in reverse direction through the inner regenerator tubes 41 to the manifold 46. From the regenerator manifold 46 the liquid condensate flows through a plurality of circumferentially equally spaced radial passages 57 and conduits 58 each of which is connected to one of the inlet manifolds 59 to the pre-heater P and returned to the boiler B.

As shown in FIG. 3, each of the passages 57 is connected at its outer end to the manifold 46 and extends a short distance radially inward therefrom. The inner end of each of the radial passages 57 is connected to the inlet end of an axially extending inner leg portion 58*a* of one of the conduits 58 each of which also includes a radially outward extending leg portion 58*b* that terminates in a short axial outer leg portion 58*c* that is connected to a manifold 59 of the pre-heater P. The inner axial leg portions 58*a* of the conduits are located radially inward of the inner regenerator tubes 41 in order to insure that the regenerator tubes 41 and 42 will be flooded with liquid condensate at all times. In the embodiment of the invention shown the radial leg portions 58*b* of the conduits 58 are disposed exteriorly of the rotary housing H, and are enclosed within suitable insulating material 60 to thermally insulate said conduit portions from the ambient atmosphere.

The location of the regenerator R in a rotating Rankine cycle engine is important. The radial position of the regenerator must be between the maximum liquid level 61 in the condensate return passages 56 and the liquid level $x—x$ in the boiler B. Also, the regenerator must be spaced radially outward from the engine axis so that the pressure head on the liquid in the regenerator tubes 41 and 42, when heated by the super-heated exhaust vapor pumped through the regenerator, is high enough to prevent the liquid in said tubes 41 and 42 from boiling. That is, the difference in radius between the maximum liquid level 61 in passages 56 and the innermost portion of the regenerator tubes 41 is sufficient, under the action of the centrifugal force on the liquid, to provide sufficient pressure to prevent boiling of the liquid in the regenerator.

In a rotary Rankine cycle engine which has no regenerator, the boiler pressure is provided by the action of the centrifugal force on the liquid leg between the level at 61 in passages 56 and the boiler liquid level $x—x$. However, the presence of the regenerator R splits the liquid leg into two portions. That is, there is an inner liquid leg between the liquid level 61 in passages 56 and the liquid level 62 in passages 57 and the liquid leg between the liquid level 63 in conduit 58 and the level $x—x$ in the boiler B. The saturated vapor in the conduits 58 between liquid levels 62 and 63 is at an intermediate pressure which is the vapor pressure of the liquid at the temperature the liquid leaves the regenerator R. The levels of the two liquid legs are automatically self-adjusting and provide the necessary total pressure for the boiler B, and the height of the liquid legs between levels 61 and 62 just balances the difference in vapor pressure between the fluid in the conduit 58 and the fluid in the condenser C plus the fluid flow pressure drop between liquid levels 61 and 62. For example, as the regenerator heats up at constant boiler pressure, the regenerator exit liquid temperature increases. As a result, the liquid level 61 moves radially inward to provide a greater liquid leg between the levels 61 and 62 while the liquid leg between levels 63 and $x—x$ in the boiler decreases. During these changes, the total pressure provided by the two liquid legs remains constant.

In the illustrated embodiment of the invention, after start-up of the engine and with the liquid in the boiler B heated to the required temperature and pressure, the housing-boiler-condenser unit is rotationally driven continuously by the primary power output generated by the engine by means of an internal oxxluded fixed-ratio gear train arranged coaxially of the engine axis within the housing H, for example, as shown and described in Bechtold U.S. Pat. No. 3,769,796, issued Nov. 6, 1973.

Figure 5:
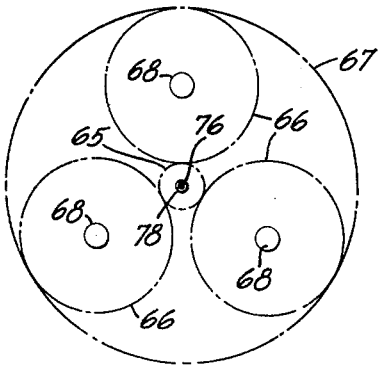
FIG. 5 is a schematic view on line 5—5, FIG. 1.

As shown in FIGS. 1 and 5 of the drawings, the gear train is in the form of a planetary gear system comprising a sun gear 65 fixedly mounted on and driven by the turbine shaft 26. Meshed with the sun gear 65 is a plurality of planetary gears 66 that are also meshed with a circumscribing annular ring gear 67. The ring gear 67 is mounted on and carried by an annular shoulder 67*a* that is formed integral with the rotary housing H. In the present embodiment as shown in FIG. 5 of the drawings, three planetary gears 66 are provided and arranged in equally spaced relation circumferentially about the engine axis. Each of the planetary gears 66 is rotatably mounted on a stub shaft 68 by means of a bearing 69 and each stub shaft 68 is fixedly mounted in a stationary spider portion 10*a* provided at the inner end of the stationary shaft 10 whereby the axes of the planetary gears 66 are fixedly positioned so that they do not rotate or move circumferentially relative to or about the engine axis. Thus the full power output of the engine turbine T is transmitted from the driving sun gear 65 through the planetary gears 66 directly to the driven ring gear 67 and the rotary housing-boiler-condenser unit at the fixed-speed ratio of the particular gear train.

The turbine shaft bearings 27 and the bearings 8 of the stationary shaft 10 as well as the several gears in the gear train are lubricated by a force feed system utilizing a Pitot type pump as shown and described in U.S. Pat. No. 3,744,246, issued July 10, 1973, and comprising a radial passage 70 formed in the stationary spider 10*a* and having at its outer end an L-shaped tip 71*a* the inlet end of which is immersed in an annular bath of lubricant 72 in a sump 73 with the inlet thereto facing opposite the direction of rotation of the engine. The inner end of the passage 70 is connected to a coaxial passage 74 formed in the spider portion 10*a* and extending into the adjacent end portion of the shaft 10 where it connects with a radial passage 75 that opens between the bearings 8. A coaxial passage 76 extends through the sun gear 65 and adjacent portion of the turbine shaft 26 where it connects with a radial passage 77 that opens between the axially spaced turbine shaft bearings 27. The connection between the non-rotating passage 74 and the passage 76 in the rotating sun gear 65 and turbine shaft 26 may be made by means of a connector tube 78 having one end fixed in the passage 76 and the other end mounted coaxially within the stationary passage 74 by means of a suitable seal, for example, as shown and described in my aforesaid U.S. Pat. No. 3,744,246.

In operation of the engine, it will be apparent at start-up that there will be no pressure vapor generated by the boiler to drive the internal expander and in turn the rotary housing-boiler-condenser unit. Consequently, at start-up it is necessary to independently drive the housing-boiler-condenser unit at the designed predetermined speed of rotation to establish and maintain the liquid/vapor interface *x* in the boiler B until the liquid in the boiler is heated to the temperature to produce the desired pressure vapor to drive the turbine T. This may be accomplished, for example, by means of a starter motor M driving a pulley 80 fixed on shaft 4 through a belt or chain 81. Means such as a clutch (not shown) can be provided for breaking the drive between motor M and pulley 80 when the engine attains normal operation, or the motor can continue to be driven by the rotating housing-boiler-condenser unit and shaft 4 and function as a generator operable, for example, for charging a battery that powers accessories such as the starter motor, lights and the like. A power take-off 82 or other suitable driving connection is provided at the outer end of the output shaft 4 which may be used to drive any selected equipment or machinery such as, for example, a wheeled vehicle, boat, or otherwise, as desired.

In normal operation of the rotary engine, with the liquid in the rotary boiler B heated to the required temperature and pressure, the pressure vapor generated in the boiler is discharged inwardly through the tubes 30 and passages 31 to the manifold 29 and thence through nozzles 28 into impinging contact against the turbine blades 24 thereby driving the turbine rotor 23 and shaft 26 at the desired speed of rotation. The shaft 26, through the occluded fixed-ratio gear train previously described, drives the housing-boiler-condenser unit and the shaft 4 at a predetermined speed of rotation relative to the speed of shaft 26 determined by the fixed ratio of the gear train. In the embodiment of the invention shown, the direction of rotation of the housing-boiler-condenser unit and the shaft 4 is opposite the direction of rotation of the turbine shaft 26.

The exhaust vapor from the turbine enters the diffuser 33 from which it is discharged to the exhaust chamber 34 and thence radially to the regenerator chamber 22. Exhaust vapor received in the chamber 22, flows outward through the fins 54 and 55 of the regenerators as previously described and then flows through the passages 37 and manifold 38 into the heat exchange tubes 40 of the condenser C where it is condensed by the cooling fluid discharged outwardly between the fins 39 as previously described. The boiler liquid condensate flows axially inwardly and out of the condenser tubes 40 returning to the manifold 38 and enters the passages 56 by which is is conveyed to the regenerator R. Condensate reaching the regenerator flow sequentially through the tubes 42 and 41 thereof where it is heated by heat exchange with the turbine exhaust vapor pumped through the regenerator fins 54 and 55. The liquid condensate heated in the regenerator R then flows through the pre-heater P where it is further heated and returned to the boiler B, whereupon the cycle is repeated.

A typical design of a rotary engine embodying the regenerator construction shown and described comprises a boiler B having an axial length of 3.50 inches and a diameter so that the liquid/vapor interface *x—x* is spaced 7.00 inches from the rotation axis of the engine. The regenerator R comprises 70 inner heat exchange tubes 41 each having a thermally effective axial length of 2.00 inches, an inside diameter of 0.250 inch, an outside diameter of 0.313 inches, and 70 outer heat exchange tubes 42 of the same diameter each having a thermally effective length of 2.00 inches. The tubes 41 and 42 are equally spaced circumferentially on 10.094 inch and 11.406 inch diameter centers, respectively. The array of annular fins 54 and 55 on each of the tubes 41 and 42, respectively, has an axial length of 2.00 inches, the thickness of the fins is 0.006 inches and the axial spacing between adjacent fins is 0.006 inches. The inner radius of the inner fins 54 is 4.75 inches and the outer radius of the outer fins 55 is 6.00 inches. The radial space between the inner fins 54 and the outer fins 55 is 0.063 inches. Each of the tubes 41 and 42 are filled with spheres 52 of the same material as the tubes for an axial length of 2.00 inches. At least the axial portion of each tube coincident with the axial portion of the tube containing the array of annular fins 54 and 55 contains elements 52. Optionally, tubes 41 and 42 may be filled more completely to minimize liquid holdup as previously discussed. The spheres have a nominal diameter of 0.040 inches and the tube and sphere assembly is sintered to insure metallurgical bonding and hence good thermal contact between individual spheres and between the spheres and the inner tube wall.

The pre-heater P comprises 70 heat exchage tubes 84, each having a thermally effective axial length of 2.23 inches and an outside diameter of 0.375 inches. The tubes are equally spaced circumferentially on 17.125 inch diameter centers, and, in accordance with the present invention, the tubes 84 of the pre-heater P preferably are also filled with spheres or balls 86 and sintered as described with reference to the tubes of the regenerator. The array of annular fins 85 on the pre-heater tubes 84 has an axial length of 2.23 inches, the fins each have a thickness of 0.030 inches and the axial spacing between adjacent fins is 0.063 inches. Each of the fins 85 has an inner diameter of 16.50 inches and an outer diameter of 18.250 inches. The design speed of rotation of the boiler is 3000 rpm.

Using as the boiler liquid a mixture of trichlorodifluorobenzene isomers as disclosed in Bechtold and Tullock U.S. Pat. No. 3,774,393, issued Mar. 27, 1973, and using, for example, kerosene, as the combustion fuel, the specifications of a typical operation of a Rankine engine embodying the foregoing regenerator are as follows:

| | |
|---|---|
| Boiler temperature (° F) | 620. |
| Boiler pressure (p.s.i.a.) | 149. |
| Condenser temperature (° F) | 243. |
| Condenser pressure (p.s.i.a.) | 1. |
| Regenerator effectiveness (fraction regeneration) | 0.70 |
| Regenerator condensate inlet temperature (° F) | 243. |
| Regenerator condensate exit temperature (° F) | 345. |
| Regenerator vapor inlet temperature (° F) | 441. |
| Regenerator vapor exit temperature (° F) | 301. |
| Rankine cycle efficiency | 0.293 |
| Power fluid flow rate (lb./sec.) | 0.186 |
| Turbine shaft power (hp) | 8.2 |
| Turbine speed (r.p.m.) | 48,000. |
| Boiler heat load ($10^3$ Btu/hr) | 101. |
| Condenser heat load ($10^3$ Btu/hr) | 80. |
| Regenerator heat load ($10^3$ Btu/hr) | 18. |

From the foregoing it will be apparent that the present invention provides a regenerator of novel design and construction for rotary boiler and combustor devices that is characterized by a high ratio of heat transfer surface to heat exchange volume, as well as a high ratio of cross sectional area for flow to vapor flow path length so as to minimize vapor pressure drop. The regenerator of the present invention also provides a high vapor side convective heat transfer coefficient as well as a low liquid side thermal resistance. Furthermore, the regenerator of the present invention has minimum liquid holdup thereby minimizing the effect of temperature variations on the boiler-liquid level.

While certain embodiments of the invention have been shown and described, it is not intended to limit the invention to such disclosures, and changes and modifications may be made and incorporated as desired within the scope of the following claims.

We claim:

1. A rotary Rankine cycle engine comprising:

a cylindrical housing rotatable about its axis a coaxial annular boiler associated with said housing and rotatable therewith, said housing and boiler adapted to be rotated at a first predetermined speed to maintain in the boiler an annular body of boiler liquid having a liquid/vapor interface spaced a predetermined distance radially from said axis, means to rotationally drive the housing and boiler at said first predetermined speed, means to heat the liquid in the boiler and generate pressure vapor therein, an expander mounted coaxially within the housing for extracting work from the pressure vapor generated in the boiler and including a coaxial driving member rotatably driven thereby at a second predetermined speed, an annular regenerator chamber radially inward of the boiler defined by portions of the housing, means for discharging exhaust vapor from the expander and delivering same to the regenerator chamber, an annular regenerator in said chamber rotatable with the housing comrpising at least one annular series of a plurality of equally circumferentially spaced axially extending heat exchange tubes each having thereon an array of a plurality of axially spaced annular fins operable by rotation thereof to convey exhaust vapor discharged to said chamber outwardly between said fins, a plurality of small elements of high thermal conductivity substantially filling each of the heat exchange tubes of said regenerator, a condenser for the exhaust vapor mounted coaxially adjacent the housing and rotatable therewith, means for conducting exhaust vapor after passage through the regenerator to said condenser and for returning liquid condensate therefrom to the regenerator for passage through the tubes thereof in heat exchange relation with exhaust vapor conveyed between the fins thereon, and means for returning the liquid condensate to the boiler after passage through the regenerator tubes.

2. A rotary engine as claimed in claim 1 wherein the regenerator comprises a plurality of radially spaced concentric series of circumferentially equally spaced axially extending heat exchange tubes each having thereon an array of a plurality of axially spaced annular fins.

3. A rotary engine as claimed in claim 2 wherein connections are provided between the regenerator tubes of adjacent concentric series so that liquid condensate flows first through the radially outermost series of tubes and then sequentially through the inner series of tubes in counter cross flow heat exchange relation to the flow of exhaust vapor through the fins on the tubes.

4. A rotary engine as claimed in claim 1 wherein the small elements of high thermal conductivity in the regenerator tubes are of sinterable material and said tubes and said elements therein are sintered to bond the elements to one another and to said tubes.

5. A rotary engine as claimed in claim 2 wherein each of the regenerator tubes in both concentric series thereof is substantially filled with a plurality of small elements of high thermal conductivity.

6. A rotary engine as claimed in claim 5 wherein the small elements of high thermal conductivity in the regenerator tubes are of sinterable material and said tubes and said elements therein are sintered to bond the elements to one another and to said tubes.

7. A rotary engine as claimed in claim 1 wherein the means for returning liquid condensate from the regenerator to the boiler includes a rotatable pre-heater comprising an annular series of equally circunferentially spaced axially extending heat exchange tubes spaced radially outward from the boiler, each of said tubes having thereon an array of a plurality of axially spaced annular fins, and each of the tubes of the pre-heater is substantially filled with a plurality of small metal elements of high thermal conductivity.

8. A rotary engine as claimed in claim 7 wherein the pre-heater tubes and small elements therein are sintered to bond said elements to one another and to said tubes.

9. A rotary engine as claimed in claim 1 wherein the condenser comprises a plurality of circumferentially equally spaced axially extending heat exchanger tubes each having thereon an array of axially spaced annular fins and said condenser tubes are spaced radially from the rotation axis of the engine a distance less than the heat exchange tubes of the regenerator.

10. A rotary engine as claimed in claim 7 wherein the condenser comprises a plurality of circumferentially equally spaced axially extending heat exchanger tubes each having thereon an array of axially spaced annular fins and said condenser tubes are spaced radially from the rotation axis of the engine a distance less than the heat exchanger tubes of the regenerator.

* * * * *